US005224508A

United States Patent [19]

Bates, Jr.

[11] Patent Number: 5,224,508

[45] Date of Patent: Jul. 6, 1993

[54] PROTECTIVE AUTOMATIC DISHWASHING SYSTEM

[76] Inventor: Charles R. Bates, Jr., 15325 SE. Linden La., Milwaukie, Oreg. 97222

[21] Appl. No.: 891,555

[22] Filed: May 29, 1992

Related U.S. Application Data

[63] Continuation-in-part of Ser. No. 795,058, Nov. 11, 1991, abandoned.

[51] Int. Cl.[5] ..... F16K 23/00

[52] U.S. Cl. ..... 137/312; 4/251.1

[58] Field of Search ..... 137/312, 313, 362; 222/108, 109, 111; 4/251.1

[56] References Cited

U.S. PATENT DOCUMENTS 4,889,155 12/1989 Trotter, Sr. ..... 137/312

4,903,723 2/1990 Sublett ..... 137/312

*Primary Examiner*—Martin P. Schwadron

*Assistant Examiner*—Kevin L. Lee

*Attorney, Agent, or Firm*—Marger, Johnson, McCollom & Stolowitz

[57] ABSTRACT

A automatic dishwasher protective system is provided for intercepting and preventing an accumulation of leakage liquid into an area beneath the dishwasher prior to the leakage liquid contacting the underlying surface on which the dishwasher is supported. It also includes an element in the intercepting and preventing means for diverting leakage liquid from the dishwasher away from an area beneath the dishwasher, and alerting a user of the dishwasher that leakage liquid is being emitted into the area beneath the dishwasher. The protective device includes a wedge-like rear wall for installing the protective device beneath an installed dishwasher without requiring the removal of the dishwasher.

7 Claims, 2 Drawing Sheets

PROTECTIVE AUTOMATIC DISHWASHING SYSTEM

BACKGROUND OF THE INVENTION

This application is a continuation-in-part of, and hereby claims priority from, application Ser. No. 07/795,058, entitled "Protective Automatic Dishwashing System", filed Nov. 11, 1991, now abandoned.

This invention is directed to an automatic dishwashing system which protects the dishwasher and underlying surface on which it is supported from drippage from the dishwasher.

Dishwasher drippage has been handled in differing ways. Appliance drip pans, and specifically dishwasher drip pans, are well known in the prior art. An example of a dishwasher drip pan is U.S. Pat. No. 3,096,781 to Roidt. The Roidt device is used to collect drippage from a built-in dishwasher, and redirect the drippage to the exterior of the building. The Roidt drip pan is comprise of a flat bottom with four vertical walls, i.e. front, rear, and side walls. Each corner of the flat bottom is fitted with a foot which supports the drip pan in a level position slightly elevated above the floor. The bottom of the drip pan has openings through which lag screws pass and secure the drip pan to the floor. A drainage opening is provided in either the bottom or rear wall. The drip pan is first installed on the underlying surface, and the dishwasher is then placed within the walls of the Roidt device. When installed, a drainage tube is attached to the drainage opening which serves to conduct any leakage through an outside wall to the exterior of the building. The drip pan operates by intercepting any drainage before it reaches the floor, confining the drainage to the area beneath the dishwasher, and conducting the drainage through an opening to the exterior of the building.

The Roidt drip pan is not suitable as a protective drip pan for an automatic dishwasher for several reasons. First, the Roidt drip pan has a number of structural features which require a complex molding process, and assembly of separate components into the final product. The features include small feet for elevating the bottom of the pan above the floor, openings for drainage and attachment of the drip pan to the floor, collars for the attachment openings, and the means for attaching the drainage tubing to the drainage opening. These structural features increase the cost of the Roidt drip pan.

Second, the Roidt drip pan requires modification of the building for installation of an attached drain tube which conducts the drainage to the exterior of the building. Installation also requires tubing connections and installation of lag screws and support blocks. These installation requirements add cost and complexity to what is at first glance a rather simple invention.

Third, the Roidt drip pan fails to provide any protection for the dishwasher by failing to alert the occupant of the building that leakage is emitting from the dishwasher. Small amounts of leakage can indicate impending serious failure of the dishwasher, or possibly lead to serious failure if unchecked (e.g. seal failure contributing to bearing failure). Since the building occupant is not alerted to take corrective action, the condition is likely to worsen, possibly leading to greater damage than if the drip pan were not used.

Finally, the Roidt drip pan could lead to greater damage to the building than if no drip pan were used since continual, undetected drainage to the immediate vicinity of a building exterior has the potential to cause damage to the foundation of the building.

The Roidt drip pan poses another potential hazard to the building as well. The open drainage tube leading directly to the exterior of the building provides a direct route for pests from the exterior to the interior of the building.

A washing machine water catcher is described in U.S. Pat. No. 3,304,950 to Hubert. The Hubert water catcher is comprised of a bottom wall attached to vertical rear and side walls, and a removable front wall. The bottom wall of the water catcher is fitted with runner plates over which the base of the washing machine slides during installation. A separate drain valve is provided in the front wall for drainage of collected water. The inside area of the water catcher is larger than the base of the washing machine to allow the base of the washing machine to fit completely within the water catcher. The Hubert water catcher is installed by removing the washer, placing the water catcher on the floor, removing the front wall of the water catcher, sliding the washing machine into the water catcher, and replacing the front wall.

The Hubert water catcher is not suitable for use as a dishwasher protective drip pan for a number of reasons. First, the Hubert water catcher allows drainage to accumulate beneath the dishwasher unseen and otherwise unnoticed by the occupant of the building. The accumulation of drainage beneath a built-in dishwasher can lead to mildew and molds, and may provide breeding sites and sustenance for insects or other pests in a room of the house where cleanliness is of great importance. The Hubert invention thus fails to prevent or cure some of the major damaging effects of drainage from a built-in dishwasher. In addition, the spigot protruding from the front wall would be a tripping hazard for the building's occupants.

The Hubert water catcher also has structural features which require a complex molding process and the assembly of separate components adding to the cost of the final product. The features include cleats molded into the bottom and side walls to hold the runner plates, the hole and spigot assembly in the front wall, and precisely sized channels in the side walls to receive and seal the edges of the removable front wall.

A refrigerator drip pan is disclosed in U.S. Pat. No. 1,584,175 to Irons. The Irons refrigerator drip pan is a container for collecting and containing condensation and drip from the waste pipe of the ice chamber of the refrigerator. It is comprised of a rectangular box with a recessed lid. The lid has two recessed channels to guide the drips from their point of impingement near the center of the lid to holes at the front corners of the lid, where the drips fall into the box. A roller is fitted near the rear of the bottom of the pan to aid in removing the pan from beneath the refrigerator. The drip pan is installed completely beneath the refrigerator, and is hidden from view by the lower front panel of the appliance. Periodically, the box must be removed and emptied. The pan is fitted with an overflow hole in the front wall to remind the forgetful building occupant to remove and empty the filled pan. The overflow discharges to the area beneath the refrigerator behind the front cover.

The Irons refrigerator drip pan is unsuitable for use as a protective drip pan for a built-in dishwasher. First, the Irons drip pan is too tall to fit beneath a typical built-in dishwasher. Next, the Irons drip pan is designed to accumulate drainage in an enclosed area beneath the appliance, unseen and otherwise unnoticed by the occupant of the building. The accumulation of drainage beneath a built-in dishwasher can lead to mildew and molds, and may provide breeding sites and sustenance for insects or other pests. The Irons invention thus fails to prevent or cure some of the major damaging effects of drainage from a dishwasher.

The Irons drip pan has a number of structural features which require complex forming steps and assembly of separate components into the final product. The features include recessed channels in the lid, an internal baffle, an overflow hole in the front wall, a roller on the bottom of the pan, and a handle on the front of the pan. These structural features increase the cost of the Irons drip pan. When filled, the Irons drip pan discharges through the overflow hole in the front wall to the enclosed area beneath the refrigerator. The building occupant is not alerted to the presence of drainage from the appliance until the pan fills, overflows, and the drainage spreads from beneath the front cover of the dishwasher. The building occupant is not alerted that the machine is malfunctioning for a potentially long time. The delay could lead to damage to the dishwasher and the floor beneath.

A drip pan for refrigerators is also disclosed in U.S. Pat. No. 1,057,654 to Menzl. The Menzl drip pan is a pan mounted on a tiltable support in such a was as to automatically tilt and slide forward from beneath the refrigerator when a predetermined amount of water has accumulated in the pan. The Menzl drip pan was designed for refrigerators which were "ice boxes", and which had a slow, continuous discharge of water from the ice box drain pipe as ice in the ice storage chamber slowly melted. It was therefore convenient and useful for an ice box drip pan to accumulate a quantity of water from the melted ice for the convenience of the user.

Other prior art patents exist which relate to drip pans. U.S. Pat. No. 2,479,000 to Buczkowski is directed to a drip pan for a toilet flush tank. U.S. Pat. No. 4,527,707 to Heymann et al. describes a tray for use inside an automatic dishwasher to catch debris from the glass tray. U.S. Pat. No. 3,662,912 to Calle describes a drip tray for use inside a refrigerator, beneath the freezer compartment. These inventions are not suitable for use as a protective drip pan for a built-in dishwasher for reasons previously cited with respect to the Roidt, Hubert and Irons patents.

Therefore, a need exists for a dishwasher system for an automatic dishwasher which protects the dishwasher, and the underlying surface on which it is supported, from leakage liquid emitted from the dishwasher.

SUMMARY OF THE INVENTION

The present invention satisfies the existing needs described above by providing a device for protecting the dishwasher and the underlying surface on which the automatic dishwasher is supported. The protective device comprises means for intercepting and preventing an accumulation of leakage liquid from the dishwasher prior to the leakage liquid contacting the underlying surface. It also includes means in the intercepting and preventing means for diverting leakage liquid from the dishwasher and away from an enclosed area located beneath the dishwasher and alerting a user of the dishwasher that leakage liquid is being emitted from the dishwasher. The protective device further includes means for facilitating the installation of the protective device beneath the dishwasher after installation of the dishwasher on the underlying surface. The protective device is generally comprised of a flat bottom surface, a forwardly angled rear wall, and two vertical side walls. There is no front wall. The diverting and alerting means is preferably comprised of a bottom surface which extends at least as far forward as a lower front surface of the dishwasher so that leakage liquid is diverted away from an enclosed area beneath the dishwasher to an area visible to the user of the dishwasher. This is a significantly different approach than prior art devices which divert leakage liquid to the exterior of the building or to a collection pan.

The installation facilitating means includes a wedge-like rear edge for sliding beneath the dishwasher supports, and a rear wall having a deformable portion which is movable to a flat position against the bottom wall as the rear wall is slid beneath the dishwasher supports.

The present invention also provides a method of protecting an automatic dishwasher and an underlying surface supporting the dishwasher from damage resulting from leakage liquid from the dishwasher. The method comprises installing a protective device as described above without removing the installed dishwasher, and positioning the protective device for intercepting and preventing an accumulation of leakage liquid from the dishwasher prior to the leakage liquid contacting an underlying surface, diverting leakage liquid from the dishwasher away from the area beneath the dishwasher, and alerting a user of the dishwasher to the leakage liquid emitting from the dishwasher. The method can further comprise the step of diverting the leakage liquid from the dishwasher to an area visible to a user of the dishwasher.

The foregoing and other objects, features and advantages of the invention will become more readily apparent from the following detailed description of a preferred embodiment which proceeds with reference to the drawings.

DETAILED DESCRIPTION OF A PREFERRED EMBODIMENT

Figure 1:
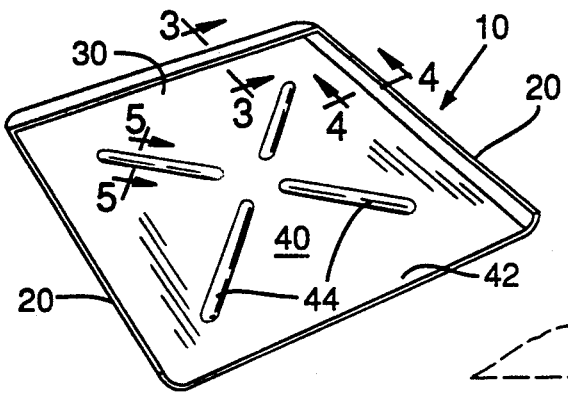
FIG. 1 shows a perspective view of a protective drip pan in accordance with the present invention.
Figure 5:
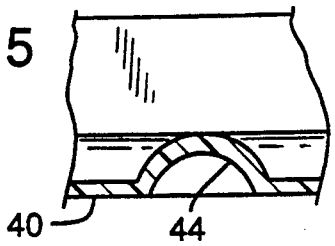
FIG. 5 shows a cross-sectional view of a reinforcing rib formed in the bottom wall of the apparatus of FIG. 1.
Figure 4:
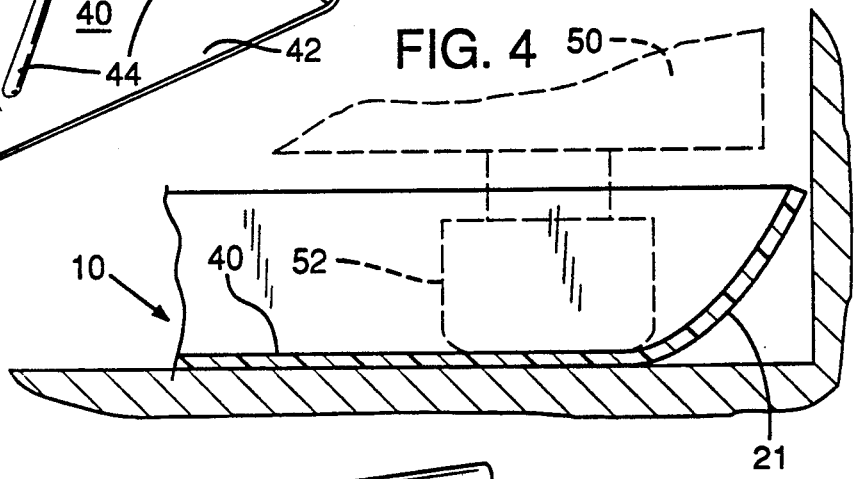
FIG. 4 shows a partial rear view of the apparatus of FIG. 1 installed beneath an automatic dishwasher.
Figure 2:
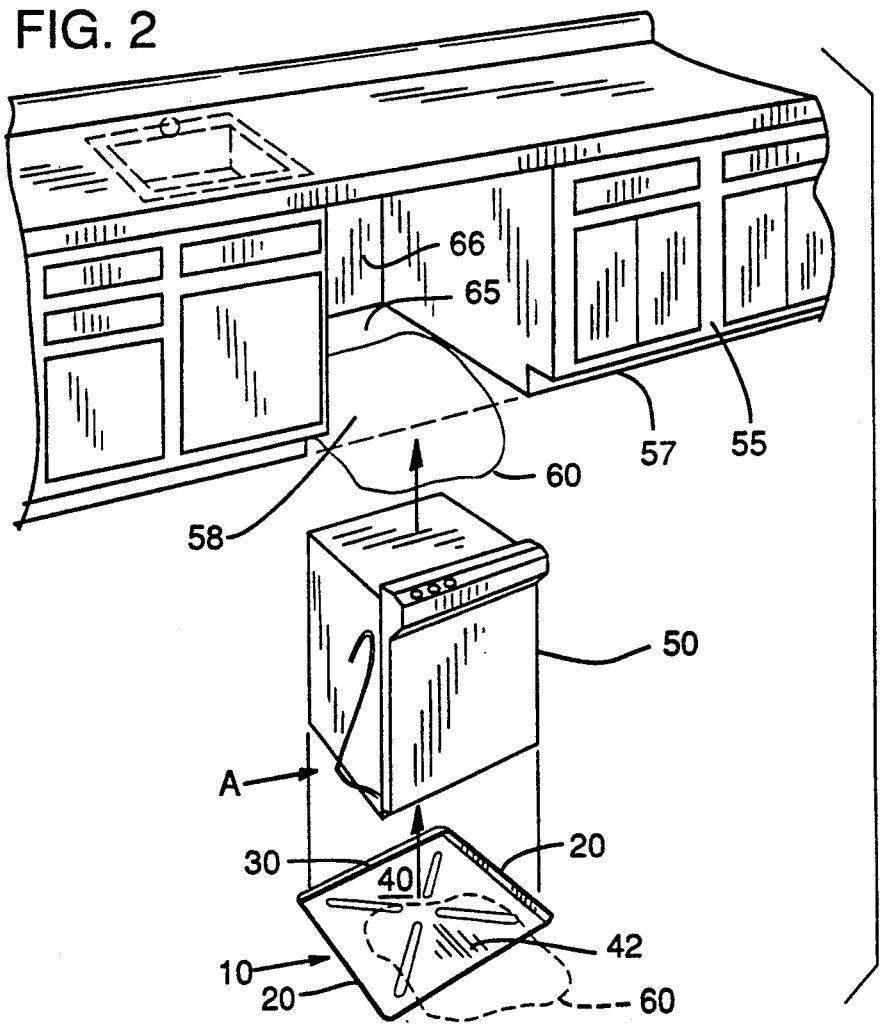
FIG. 2 shows an exploded perspective view of the apparatus of FIG. 1 installed and in use beneath an automatic dishwasher in a kitchen cabinet.
Figure 3:
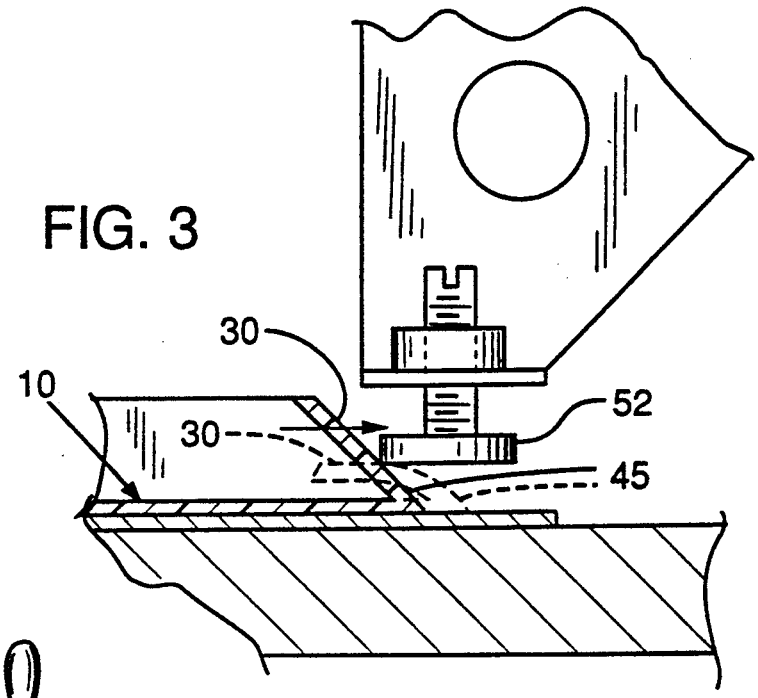
FIG. 3 shows a partial side cutaway view of the acute rear edge of the apparatus of FIG. 1 in position for installation beneath an installed automatic dishwasher which has been raised slightly off of the underlying surface.

Referring now to FIGS. 1-5, a protective drip pan 10 is shown. Drip pan 10 includes a bottom wall 40, two side walls 20 and 21, and a rear wall 30. Reinforcing ribs 44 are formed in bottom wall 40 of drip pan 10 to provide bottom wall 40 with additional structural strength to resist buckling (FIG. 5). Side walls 20 and 21 are each joined to one lateral edge of bottom wall 40 by means of a curved joint having a preferred inside radius of one quarter inch for structural strength (FIG. 4). Rear wall 30 is joined at its ends to side walls 20 and 21, and along its lower edge to the rear edge of bottom wall 40. Rear wall 30 and bottom floor 40 are joined at an acute angle and thereby form a wedge-like drip pan rear edge 45. (FIG. 3).

The protective drip pan 10 is preferably molded as a unit from a polymeric material such as ABS resin, although it may be fabricated from any resilient, impact resistant material.

The relative positions of the protective drip pan 10, an automatic dishwasher 50, and an appliance opening 58 in a kitchen cabinet 55 are shown in an exploded view in FIG. 2. The dishwasher 50 is installed within opening 58, and the drip pan 10 is installed beneath the dishwasher 50. Drip pan 10 is preferably sized so that when rear edge 45 is adjacent to rear wall 66 of opening 58, front edge 42 extends at least as far forward as the bottom front edge 57 of cabinet 55. Any liquid 60 which leaks into the area beneath the dishwasher 50 is intercepted by the drip pan 10, and eventually is diverted to an area visible to the user in front of the dishwasher 50 and the kitchen cabinet 55. The user is thus alerted to the leakage liquid 60, preventing damage to the dishwasher 50 and the underlying surface 65 from otherwise undetected leakage.

Figure 6:
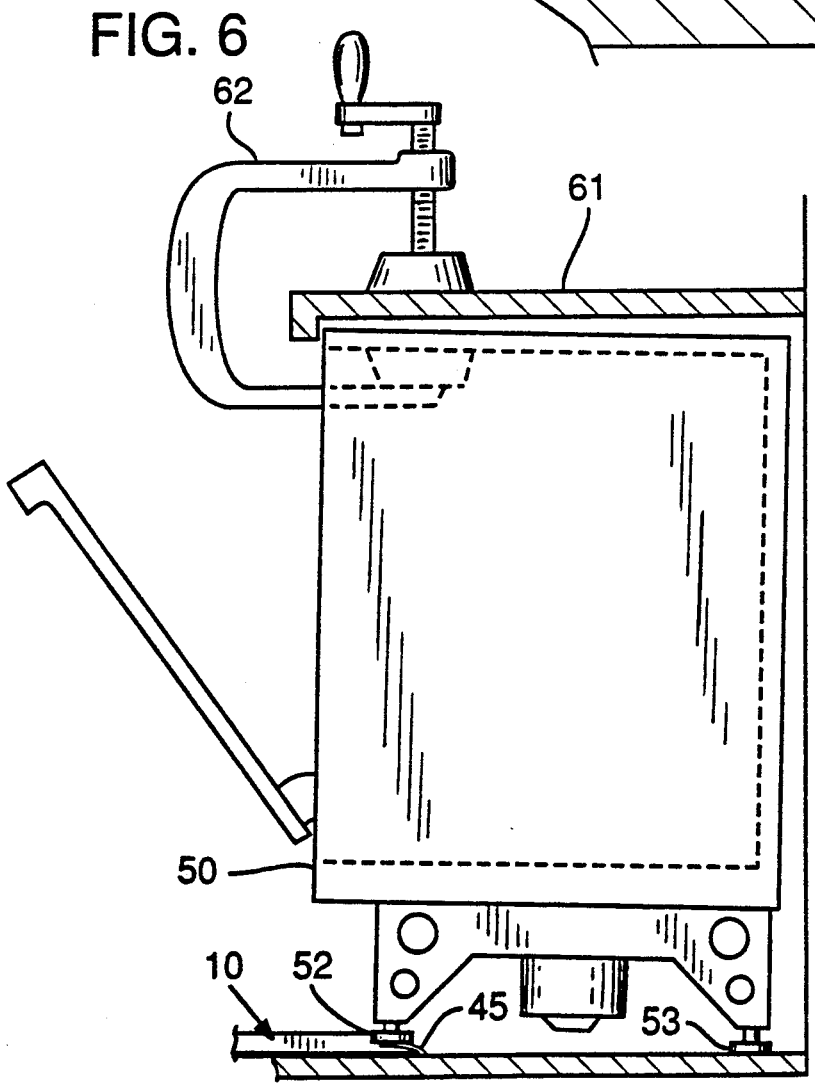
FIG. 6 shows a side view of an appliance protective device according to the present invention being installed beneath an installed automatic dishwasher which has been raised slightly off of the underlying surface.

Referring to FIGS. 3 and 6, drip pan 10 is installed beneath an installed dishwasher by the following procedure. First, the dishwasher is clamped to the counter 61 above preferably with a C-clamp 62 as shown in FIG. 6. Then, the front legs 52 of the dishwasher are adjusted upwardly to provide approximately ¼" clearance between the legs and the floor. Drip pan 10 is then pushed toward the rear of the dishwasher, causing the wedge-like rear edge 45 to slide under the raised front legs 52. By pushing on the front of drip pan 10, angled rear wall 30 is deformed downwardly and the rear edge 45 is slid beneath and past front legs 52. Drip pan 10 is then slid further under dishwasher 50 until the wedge-like rear edge 45 is against the rear legs 53. C-clamp 62 is then released, lowering front legs 52. Dishwasher 50 is then rocked forward, raising rear legs 53 off of the underlying surface. Drip pan 10 is then pushed rearward again, sliding rear edge 45 under the rear legs 53. The angled rear wall 30 again is deformed downwardly as it is pushed beneath rear legs 53, allowing rear edge 30 to slide under, and drip pan 10 to be slid into its installed position. Front legs 52 are then re-adjusted downwardly to support dishwasher 50 in its normal position. Drip pan 10 is thereby installed beneath dishwasher 50 without the need to remove it.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A device for protecting an underlying surface on which an automatic dishwasher is installed from a liquid discharged to a first area beneath said dishwasher which comprises:

means for intercepting liquid discharged beneath a dishwasher prior to said liquid contacting an underlying surface;

means for diverting an accumulation of said discharged liquid from said first area to a second area which is visible to a user for alerting said user that said liquid has been discharged from the dishwasher:

means for facilitating the installation of said protective device under said dishwasher which remains in an installed position on said underlying surface; and said means for facilitating installation comprises a resilient rear wall connected to said bottom wall at an acute forward angle, said angled rear wall having a portion which is deformable downwardly to a second position adjacent an upper surface of said bottom wall as said protective device is slid into place beneath said dishwasher.

2. The protective device of claim 1, wherein said means for facilitating said installation further comprises reinforcing ribs formed in said bottom wall to resist buckling of said bottom wall during installation of said device.

3. The protective device of claim 1, wherein said diverting means comprises said bottom wall, said rear wall, and two side walls joined to said bottom wall and to said rear wall, said bottom wall and said side walls together defining a front opening communicating with said second area for diverting an accumulation of said discharged liquid from said first area to said second area which is visible to a user.

4. A system for automatic washing which protects said system and the underlying surface on which said system is supported from leakage liquid emitted within said system, which comprises:

means for automatic washing;

means for intercepting said leakage liquid emitted into said first area prior to prevent said leakage liquid from contacting said underlying surface; and means included within said intercepting means for diverting said leakage liquid away from said first area to a second area visible to the user of said washing system, and thereby alerting said user that said leakage liquid is leaking therefrom;

said intercepting and preventing means including means for facilitating the installation of said protective device beneath said dishwasher which remains in an installed position on said underlying surface; and said intercepting means is comprised of a bottom wall, an acutely forwardly angled rear wall, and two substantially vertical side walls, said rear and side walls joined to said bottom wall, said bottom and side walls defining a front opening for diverting said leakage liquid away from said enclosed area, and further for preventing an accumulation of said leakage liquid, a resilient rear wall connected to said bottom wall at an acute forward angle, said angled rear wall having a portion which is deformable downwardly to a second position adjacent an upper surface of said bottom wall as said protective device is installed beneath said dishwasher.

5. The washing system of claim 4, wherein said diverting and alerting means includes a bottom wall having an upper surface which extends at least to said second area so that leakage liquid is diverted away from said first area to said second area which is visible to said user of said dishwasher.

6. The washing system of claim 4, wherein said intercepting means is further comprised of means for preventing accumulation of leakage liquid in said first area.

7. A method for protecting an automatic dishwasher and an underlying surface supporting said dishwasher from damage resulting from a liquid discharged into a first area beneath said dishwasher which comprises:

providing an automatic dishwasher in an installed position on said underlying surface;

providing a dishwasher protective device, said protective device comprising intercepting means, diverting means, and means for facilitating installation of said protective means in a first area beneath said dishwasher which remains in an installed position on said underlying surface;

said intercepting means comprising a bottom wall, an acutely forwardly angled rear wall and two substantially vertical side walls joined to said bottom wall;

said diverting means comprising a front opening defined by said bottom and side walls for diverting said leakage liquid from said first area to said second area for preventing an accumulation of said discharged liquid in said first area;

said means for facilitating installation of said protective device comprising said rear wall having a portion which is deformable downwardly to a second position in contact with an upper surface of said bottom wall as said protective device as it is slid into place beneath said dishwasher;

installing said protective device beneath said dishwasher which remains in an installed position on said underlying surface, said protective device being installed in a position for intercepting any leakage liquid prior to said leakage liquid contacting said underlying surface, and further for diverting said leakage liquid from said first area to a second area apart from said first area, said second area being visible to said user of said dishwasher, thereby alerting said user to said emission of leakage liquid into said first area.

* * * * *